United States Patent [19]

Yonekawa et al.

[11] 4,086,754

[45] May 2, 1978

[54] VIEWING WINDOW FOR ELECTRONIC WRISTWATCHES EMPLOYING LIGHT EMITTING DIODE DISPLAY

[75] Inventors: Masaji Yonekawa, Sakurai; Takehiko Sasaki, Yamatokoriyama, both of Japan

[73] Assignee: Sharp Kabushiki Kaisha, Osaka, Japan

[21] Appl. No.: 663,429

[22] Filed: Mar. 3, 1976

[30] Foreign Application Priority Data

Mar. 4, 1975 Japan ..... 50-29717[U]

[51] Int. Cl.[2] ..... G04B 19/06; G04B 19/34; G04B 37/00

[52] U.S. Cl. ..... 58/50 R; 58/88 G; 58/127 R

[58] Field of Search ..... 58/50 R, 88 G, 127 R; D10/30

[56] References Cited

U.S. PATENT DOCUMENTS 2,815,640 12/1957 Kirshner ..... 58/88 G

*Primary Examiner*—Stanley J. Witkowski

*Attorney, Agent, or Firm*—Birch, Stewart, Kolasch & Birch

[57] ABSTRACT

In electronic wristwatches employing an array of light emitting diodes (LED) as digital display, an ornamental coating is provided over the rear surface of a front glass sheet except the viewing window region thereof through the use of painting, printing, etc., while a color filter corresponding to the color of the light emitting display is provided at least over the viewing window region. With such an arrangement, the visibility is enhanced with a simplified construction.

6 Claims, 2 Drawing Figures

Figure 1:
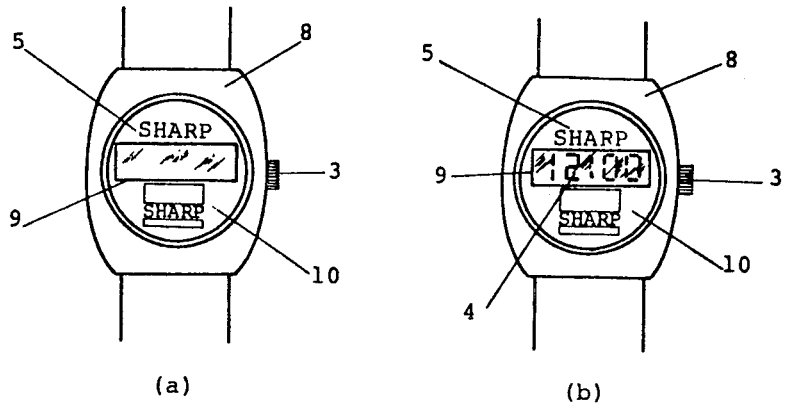

VIEWING WINDOW FOR ELECTRONIC WRISTWATCHES EMPLOYING LIGHT EMITTING DIODE DISPLAY

The present invention relates to an LED (light-emitting diodes) display wristwatch.

In the prior art battery-powered LED digital display wristwatches, colored front glass sheets of which the color corresponds to that of light emission of the LED display are utilized to facilitate recognition of digital information displayed on the LED display. Due to a relationship between power consumption of the LED display and operating life of the battery, the LED display in fact could not operate continuously and in other words could operate upon depression of a stem only when it is desired to provide a visual indication of the instantaneous time information.

Moreover, the color of the colored front glass sheets was preferably rendered darker and deeper in order to ensure that respective components rather than the LED display, for example, circuit boards and integrated circuit blocks are not viewed through the front glass sheets from the operator's eye. However, this would conflict with the desire for enhancing the visibility of the LED display and give an unfavorable impression of overall darkness. A typical example of the prior art LED display wristwatches is disclosed and illustrated in detail in U.S. Pat. No. 3,672,155 by John M. Bergy and Richard S. Walton, entitled "Solid State Watch" and issued June 27, 1972.

Accordingly, it is an object of the present invention to provide an improved viewing window for use in electronic wristwatches employing an LED digital display which can overcome the shortcomings in the prior art wristwatches as discussed above.

Figure 2:
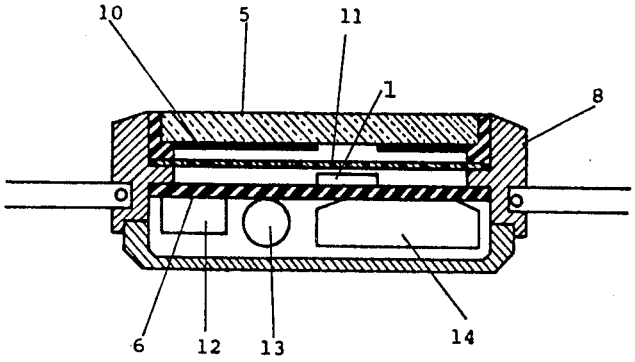

Other objects of the present invention will be readily appreciated as the same becomes better understood by reference to the following detailed description which considered in conjunction with the accompanying drawings in which like reference numerals designate like parts throughout the figures, and wherein:

FIGS. 1(*a*) and 1(*b*) are plan views of an LED display wristwatch embodying the present invention; and FIG. 2 is a cross sectional view of the LED display wristwatch of FIGS. 1(*a*) and 1(*b*).

Referring now to FIGS. 1(*a*), 1(*b*) and 2, there is illustrated an electronic wristwatch employing an array of light emitting diodes (LED) as digital display constructed in accordance with teachings of the present invention. A sheet of front glass 5 conventionally received within a case 8 is constituted of proper glass material which is transparent of slightly colored with a light color, not a dark color as required in the prior art technology. An ornamental coating 10 containing patterns, characters, markings, etc., is deposited over the rear surface of the front glass sheet 5 except over a viewing window region 9 which confronts an LED display 1 consisting of an array of light emitting diodes (for wristwatches providing a digital display of hour and minute, there is a four-digit LED array).

The deposition of the ornamental coating may be accomplished by the conventional processes such as painting, printing and vacuum deposition.

A color filter 11 is shown in FIG. 2 of which the color corresponds substantially to the color of spectrum of light emission of the LED display 1 and is intervened between the front glass sheet 5 and a circuit board 6.

For example, a red filter is employed for a red-light emitting diode display. As a consequence, only the portion of the color filter 11 corresponding to the viewing window region 9 is exposed to the outside world with the remaining portion of the color filter 11 being concealed by the ornamental coating 10.

The circuit board 6 is provided for installation of movement electronics 12 implemented with integrated circuit technology, a crystal controlled oscillator 13 for providing a time standard, and a battery 14 for the electronics 12 and the oscillator 13 within the case 8. Further details of construction and operation of these components are fully disclosed in many U.S. patents such as the above identified U.S. Pat. No. 3,672,155.

With such an arrangement, the feeling overall darkness at the watch face is precluded since only the viewing window region overlying the LED display is covered with the color filter. The respective components within the case 8 other than the LED display 1, needless to say, are not seen through the front glass sheet 5, being covered with the ornamental coating 10.

As viewed from FIGS. 1(*a*) and 1(*b*), the digital display of the instantaneous time information 4 is developed only upon depression of the stem 3. In addition, recognition of the time information 4 is facilitated by viewing through the transparent or lightcolored front glass sheet 5 and the color filter 11.

While only certain embodiments of the present invention have been described, it will be apparent to those skilled in the art that various changes and modifications may be made therein without departing from the spirit and scope of the invention as claimed.

What is claimed is:

1. A viewing window for a light emitting diode (LED) display wristwatch comprising:

a casing for accommodating components of said LED display wristwatch including an LED display;

a front glass sheet received within the casing and having a viewing window region overlying said LED display;

an oranmental coating provided over the surface of the front glass sheet except over the viewing window region; and a color filter disposed beneath the front glass sheet and over said LED display in a manner that the portion of the color filter corresponding to the viewing window region is exposed to the outside world with the remaining portion thereof being concealed by the deposition of the ornamental coating.

2. A viewing window as defined in claim 1 wherein the front glass sheet is substantially transparent.

3. A viewing window as defined in claim 1 wherein the color of the color filter substantially corresponds to the color of light emission of the LED display.

4. A viewing window as defined in claim 1 wherein the ornamental coating contains desired markings.

5. A viewing window as defined in claim 3 wherein the LED display is driven by time information derived from movement electronics contained within the casing, the time indication provided by the LED display being viewed through the front glass sheet and the corresponding color filter thereby enhancing the visibility of the LED time display.

6. An electronic wristwatch comprising:

a casing;

an array of light emitting diodes (LED) for providing a digital display of time information;

timekeeping means for providing signals for driving the LED display array, the timekeeping means being accommodated within the casing;

a front glass sheet received within the casing and having a viewing window region which is spaced from and overlying the LED display, the surface of the front glass sheet for the viewing window region being provided with an ornamental coating; and a color filter corresponding to the color of light emission of the LED display, intervened between the front glass sheet and the timekeeping means; only the portion of the color filter corresponding to the viewing window and thus the LED display being exposed to the outside world.

* * * * *